US010093459B2

(12) United States Patent
Ikegami

(10) Patent No.: US 10,093,459 B2
(45) Date of Patent: Oct. 9, 2018

(54) FLUID CONTAINER

(71) Applicant: UNICHARM CORPORATION, Shikokuchuo-shi, Ehime (JP)

(72) Inventor: Takeshi Ikegami, Kanoji (JP)

(73) Assignee: UNICHARM CORPORATION, Ehime (JP)

( * ) Notice: Subject to any disclaimer, the term of this patent is extended or adjusted under 35 U.S.C. 154(b) by 0 days.

(21) Appl. No.: 15/510,662

(22) PCT Filed: Aug. 11, 2015

(86) PCT No.: PCT/JP2015/072744
§ 371 (c)(1),
(2) Date: Mar. 10, 2017

(87) PCT Pub. No.: WO2016/039062
PCT Pub. Date: Mar. 17, 2016

(65) Prior Publication Data

US 2017/0197762 A1 Jul. 13, 2017

(30) Foreign Application Priority Data

Sep. 12, 2014 (JP) ..... 2014-186916

(51) Int. Cl.
*B67D 1/00* (2006.01)
*B65D 35/44* (2006.01)
(Continued)

(52) U.S. Cl.
CPC ..... *B65D 35/44* (2013.01); *A61J 1/1406* (2013.01); *A61J 1/1412* (2013.01); *B65D 35/38* (2013.01); *B65D 51/221* (2013.01)

(58) Field of Classification Search
CPC ..... B65D 35/44; B65D 35/38; B65D 51/22–51/222; A61J 1/1406; A61J 1/1412; A61J 1/201; B67B 7/24–7/26
See application file for complete search history.

(56) References Cited

U.S. PATENT DOCUMENTS 3,072,276 A * 1/1963 Nichols ..... B65D 41/06 215/222
3,182,843 A * 5/1965 Foye ..... B65D 41/0471 215/331
(Continued)

FOREIGN PATENT DOCUMENTS

JP 60-90142 A 5/1985
JP 1-137861 U 9/1989
(Continued)

OTHER PUBLICATIONS

International Search Report in PCT/JP2015/072744, dated Nov. 17, 2015.
(Continued)

*Primary Examiner* — Paul R Durand
*Assistant Examiner* — Randall Gruby
(74) *Attorney, Agent, or Firm* — Hauptman Ham, LLP

(57) ABSTRACT

A fluid container includes a support body having a reservoir for accommodating fluid, and a nozzle body attached to the support body. The support body has a lid for closing the reservoir. The nozzle body includes: a formation unit for forming an opening through the lid; a pipe communicating with the opening for permitting passage of the fluid; and a discharge port communicating with the pipe for discharging the fluid. In a first state, the formation unit and the lid are separated as the nozzle body and the support body are engaged. In a second state, the opening of the lid is formed as the nozzle body moves in a direction to approach the support body from the first state. In a third state, at least a part of the formation unit and the lid are separated as the nozzle body moves in an opposite direction from the second state.

11 Claims, 9 Drawing Sheets

(51) Int. Cl.

| | |
|---|---|
| ***B65D 51/22*** | (2006.01) |
| ***B65D 35/38*** | (2006.01) |
| ***A61J 1/14*** | (2006.01) |

(56) References Cited

U.S. PATENT DOCUMENTS 3,239,104 A * 3/1966 Scholle ..... B67B 7/26 222/514
3,314,429 A * 4/1967 Boehm ..... A61J 1/067 222/83
3,402,855 A * 9/1968 Schroeder ..... B65D 81/3222 220/277
3,451,576 A * 6/1969 Lewis ..... B65D 50/061 215/208
3,595,417 A * 7/1971 Musher ..... B65D 50/04 215/208
3,675,804 A * 7/1972 Micalief ..... B65D 50/04 215/217
3,812,992 A * 5/1974 Wolf ..... A61J 9/00 215/253
3,822,027 A * 7/1974 Cherba ..... B65D 41/0421 215/206
3,922,099 A * 11/1975 Christine ..... A23G 3/28 222/107
4,239,130 A * 12/1980 Altadonna ..... B60R 11/00 141/332
4,296,786 A * 10/1981 Brignola ..... A61J 1/2089 141/309
4,624,393 A * 11/1986 Lopez ..... A61J 1/06 222/83.5
4,657,151 A * 4/1987 Cabernoch ..... A61J 9/001 215/11.6
5,042,690 A * 8/1991 O'Meara ..... A45D 34/042 206/15.2
5,429,273 A * 7/1995 King ..... B05B 11/0043 222/105
5,449,078 A * 9/1995 Akers ..... B65D 41/06 215/222
5,464,123 A * 11/1995 Scarrow ..... A61J 1/14 222/83.5
5,566,845 A * 10/1996 Frank ..... B65D 25/44 215/208
5,632,315 A * 5/1997 Rose ..... A61J 1/2089 141/329
5,954,233 A * 9/1999 Kawashima ..... B65D 51/222 222/83
6,082,565 A * 7/2000 Harrold ..... B65D 50/04 215/218
6,258,078 B1 * 7/2001 Thilly ..... A61J 1/2096 206/363
6,446,823 B2 * 9/2002 Miceli ..... B65D 41/06 215/222
7,021,477 B2 * 4/2006 Wolfe ..... B65D 50/043 215/211
7,207,465 B2 * 4/2007 Weist ..... B65D 5/748 222/83
7,387,214 B1 * 6/2008 Shingle ..... B65D 41/06 215/206
7,819,264 B2 * 10/2010 Brozell ..... B65D 50/043 215/222
7,922,017 B2 * 4/2011 Shingle ..... B65D 50/045 215/218
7,980,424 B2 * 7/2011 Johnson ..... B65D 75/5877 222/105
9,579,686 B2 * 2/2017 Springhorn ..... B05C 17/00586
2004/0178220 A1 * 9/2004 Smith ..... B67D 1/0078 222/83
2008/0245314 A1 * 10/2008 Brodowski ..... A01N 25/34 119/651
2008/0245380 A1 * 10/2008 Ecker ..... A01K 13/002 132/114
2013/0168412 A1 * 7/2013 Barron ..... B65D 51/221 222/83

FOREIGN PATENT DOCUMENTS

| | | | |
|---|---|---|---|
| JP | 10-230960 | A | 9/1998 |
| JP | 2010-523417 | A | 7/2010 |
| JP | 2010-527852 | A | 8/2010 |
| JP | 2014-88206 | A | 5/2014 |

OTHER PUBLICATIONS

Office Action in JP Application No. 2014-186916, dated Feb. 20, 2018, 11pp.

* cited by examiner

FLUID CONTAINER

RELATED APPLICATIONS

The present application is a national phase of International Application Number PCT/JP2015/072744, filed Aug. 11, 2015, which claims priority to Japanese Application Number 2014-186916, filed Sep. 12, 2014.

TECHNICAL FIELD

The present invention relates to a fluid container for accommodating fluid, e.g., medicine.

BACKGROUND ART

Conventionally, a fluid container for accommodating fluid, e.g., medicine, and for discharging the accommodated fluid has been known. Patent Literature 1 discloses a fluid container for accommodating fluid. The fluid container includes a reservoir having a pierceable region and an applicator cap attached to the reservoir.

The applicator cap has a piercing tip for piercing the pierceable region. In piercing the pierceable region, a user screws the applicator cap with respect to the reservoir. Thus, the applicator cap is moved in a direction toward the pierceable region of the reservoir, and the pierceable region of the reservoir is pierced by the piercing tip of the applicator cap.

CITATION LIST

Patent Literature

Patent Literature 1: JP 2010-523417 A

SUMMARY

The applicator cap of Patent Literature 1 includes a discharge port for discharging fluid to the outside of the fluid container and a conduit through which the discharge port is communicated with the piercing tip. Thus, when the fluid is discharged to the outside of the fluid container, the fluid passes through the conduit via an end portion (an end part near the pierceable region) of the piercing tip and is delivered through the discharge port. In this case, the piercing tip of the applicator cap is retained in a position where it opened the pierceable region, and remains in the reservoir where the fluid of the reservoir is accommodated (FIG. 4B of Patent Literature 1).

However, when the piercing tip remains in the reservoir, in some cases, the piercing tip interferes with the movement of fluid toward the conduit and the fluid is left in the reservoir. In particular, for medicine, e.g., insect repellent, the balance between the amount of use and the effect is closely examined. Therefore, it is necessary to use a specified amount in a single use without excess or deficiency. Therefore, when the medicine is left in the reservoir, there is a possibility that a desired effect cannot be provided.

Thus, the present invention has been made in view of the aforementioned problem, and it is an object of the present invention to provide a fluid container in which an accommodated fluid is hardly left in a reservoir.

A fluid container (fluid container 1) according to the present disclosure includes: a support body (support body 100) having a reservoir (reservoir 101) for accommodating fluid; and a nozzle body (nozzle body 200) attached to the support body, wherein the support body has a lid unit (lid unit 102) for closing the reservoir, the nozzle body includes: an opening formation unit (opening formation unit 201) for forming an opening (opening 103) through at least a part of the lid unit; a pipe (pipe 202) communicating with the opening of the lid unit, the pipe permitting passage of the fluid; and a discharge port (discharge port 203) communicating with the pipe, the discharge port discharging the fluid, and the fluid container is configured to realize a first state where the opening formation unit and the lid unit are separated as the nozzle body and the support body are engaged, a second state where an opening of the lid unit is formed by the opening formation unit as the nozzle body moves in a first direction to approach the support body from the first state, and a third state where at least a part of the opening formation unit and the lid unit are separated as the nozzle body moves in a second direction opposite to the first direction from the second state.

Figure 1:
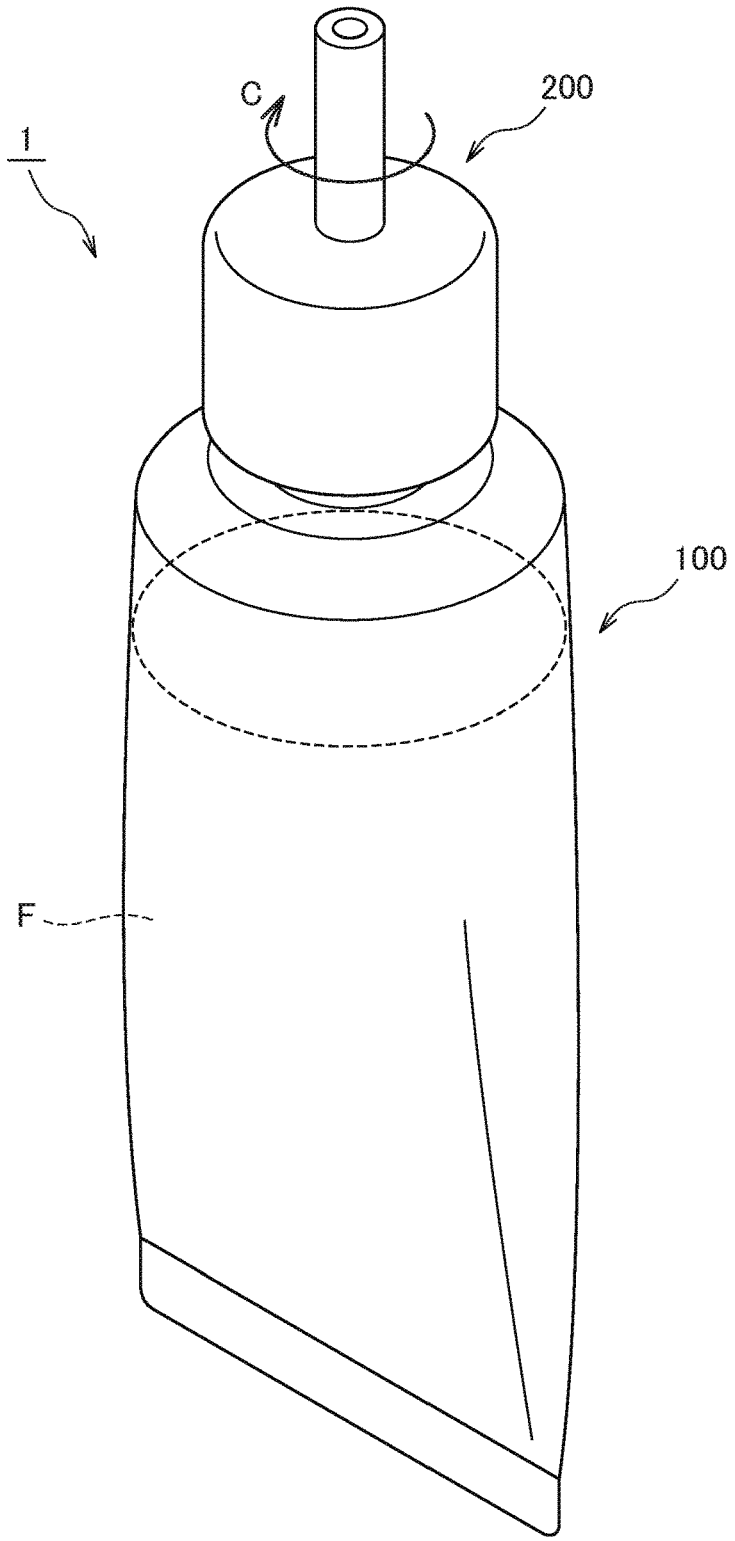
FIG. 1 is an overall perspective view of a fluid container according to an embodiment.

DESCRIPTION OF EMBODIMENTS (1) Configuration of the Fluid Container

A fluid container 1 according to an embodiment is described with reference to FIGS. 1 to 6. In the following description of the drawings, the same or like parts are designated by the same or like reference numerals. However, it should be noted that the drawings are schematic and the proportion etc. of dimensions differs from that in reality. Therefore, specific dimensions or the like should be determined in consideration of the following description. Furthermore, the relationship or proportion of the dimensions can differ from drawing to drawing.

Figure 2:
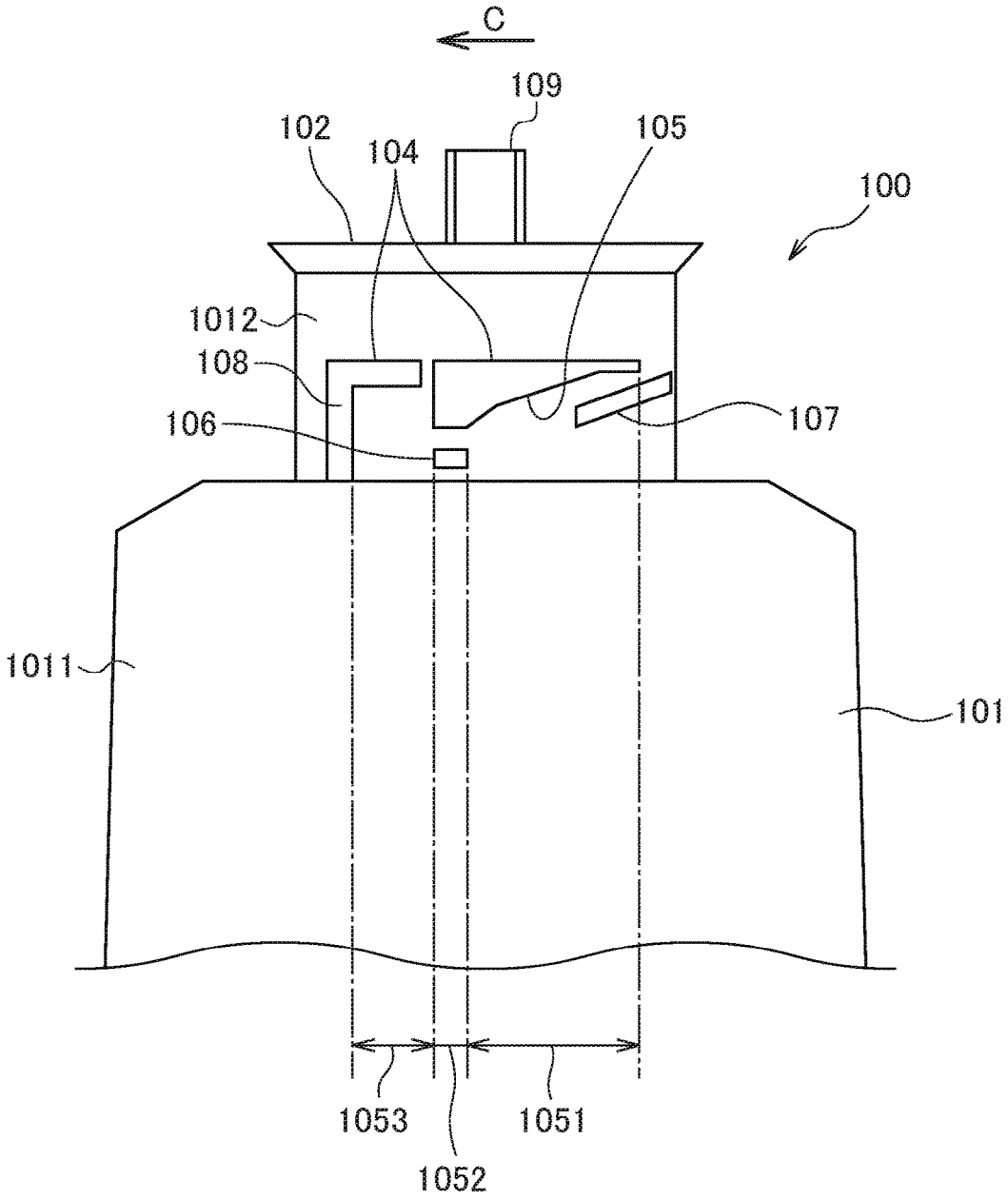
FIG. 2 is a partially enlarged front view of a support body according to an embodiment.
Figure 3:
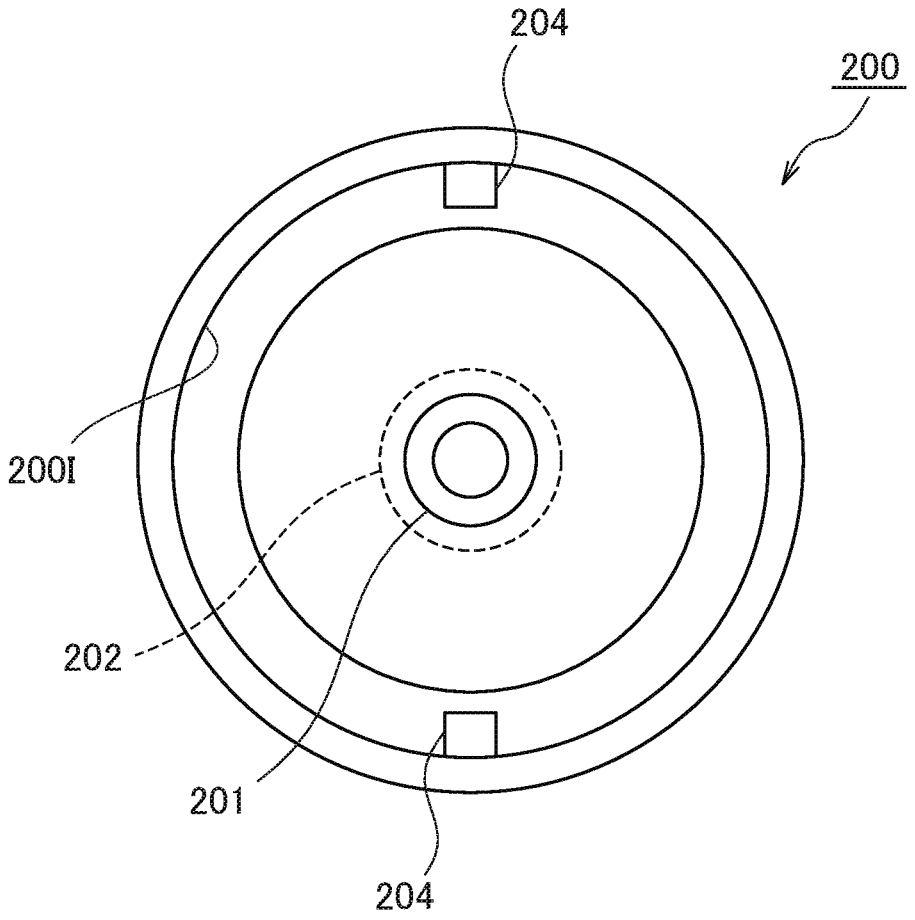
FIG. 3 is a bottom view of a nozzle body according to an embodiment.
Figure 4:
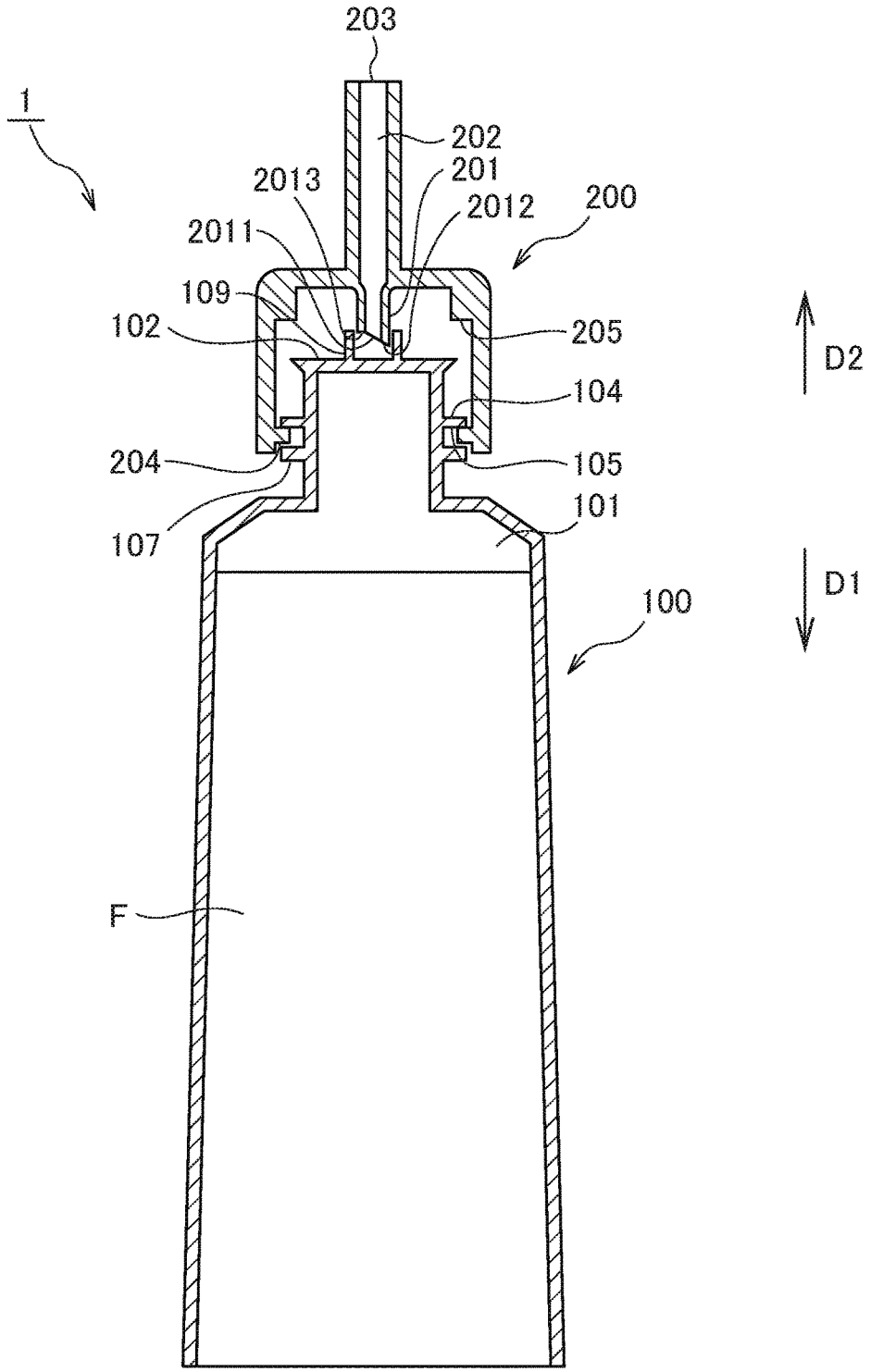
FIG. 4 is a cross-sectional view of a fluid container in a first state along a first direction.
Figure 5:
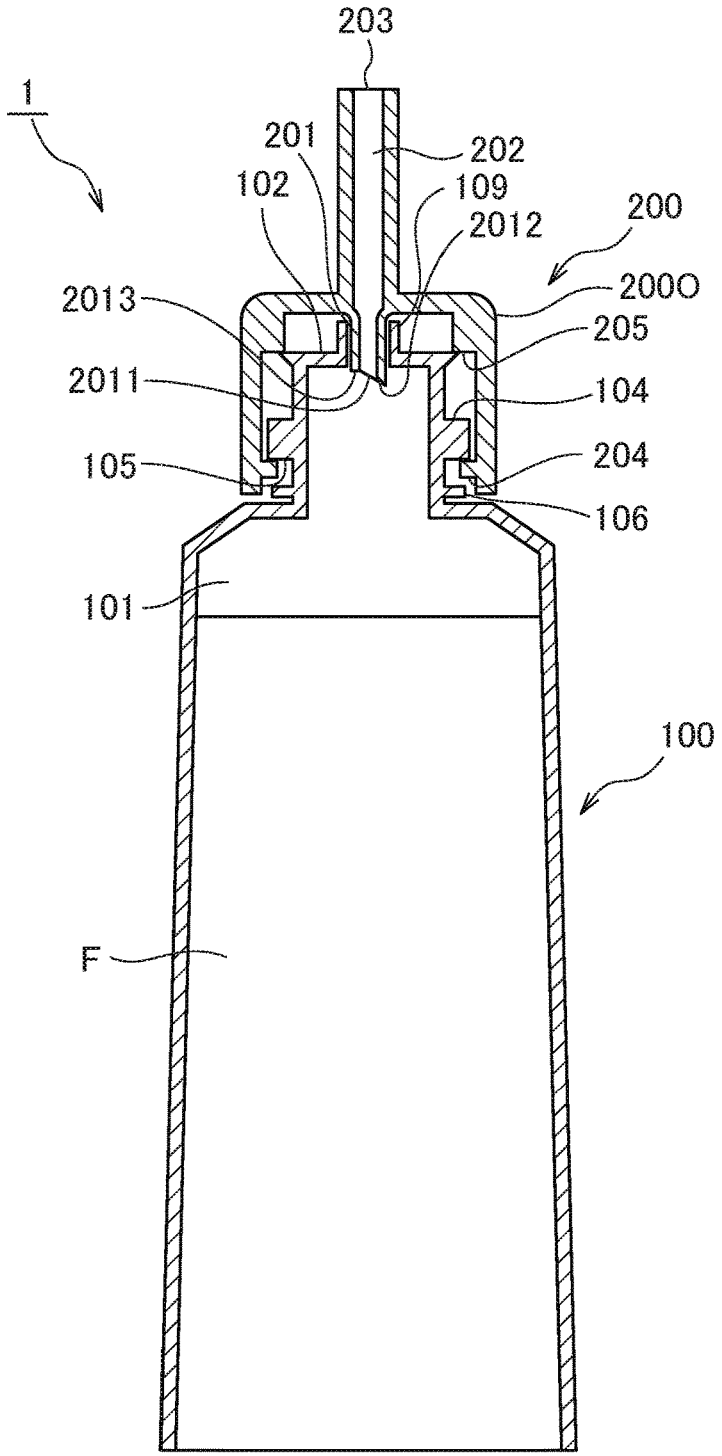
FIG. 5 is a cross-sectional view of a fluid container in a second state along the first direction.
Figure 6:
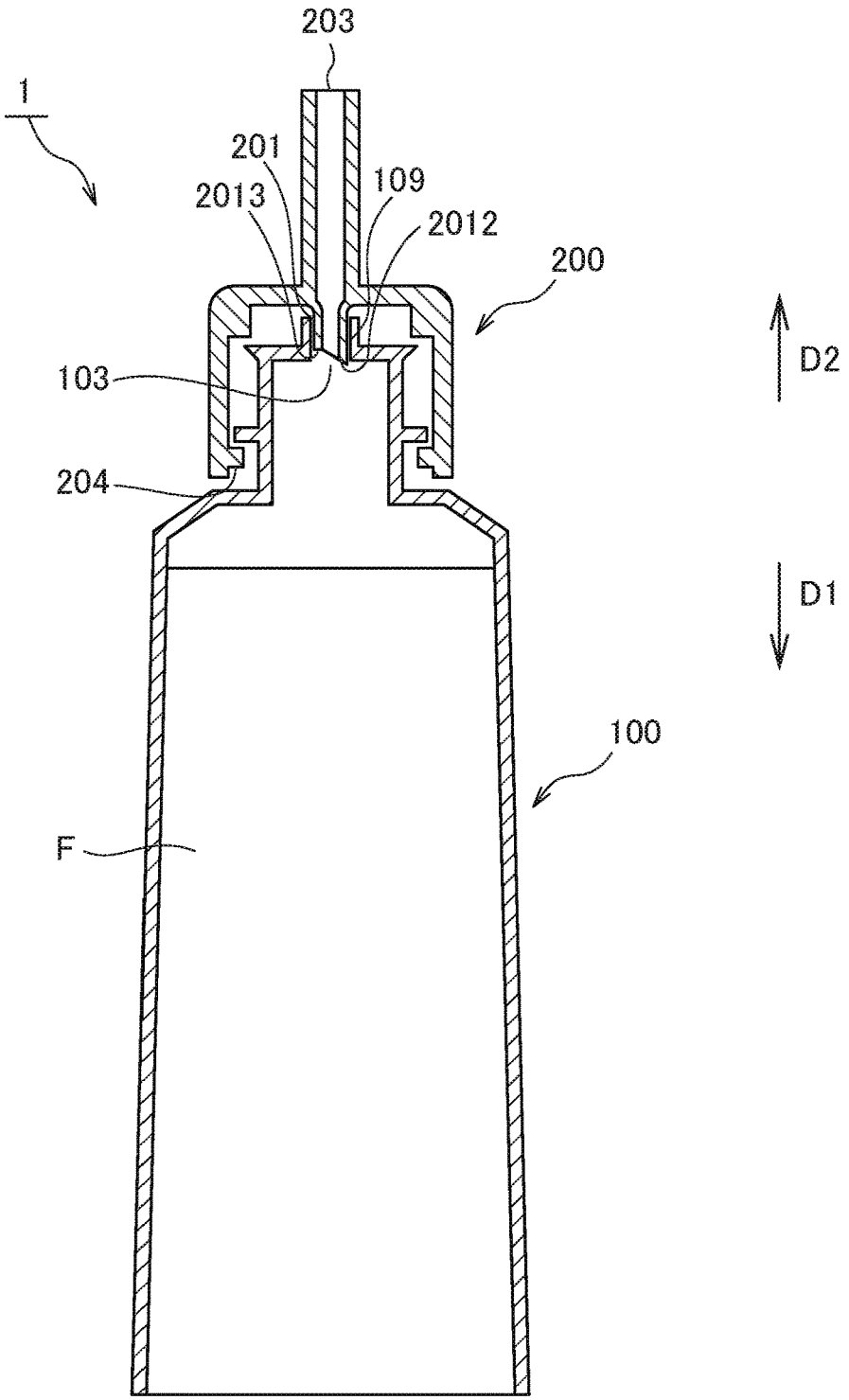
FIG. 6 is a cross-sectional view of a fluid container in a third state along the first direction.

FIG. 1 is a perspective view of the fluid container 1 according to an embodiment. FIG. 2 is a partially enlarged front view of a support body 100. FIG. 3 is a bottom view of a nozzle body 200. FIGS. 4 to 6 are cross-sectional views of the fluid container along a first direction. FIG. 4 illustrates a first state. FIG. 5 illustrates a second state. FIG. 6 illustrates a third state.

The fluid container 1 is configured to be capable of accommodating fluid F and delivering the fluid F accommodated therein toward a target in use. A user may deliver the fluid F by operating the fluid container 1 without touching the fluid F. The fluid F accommodated in the fluid container 1 is not subject to any limitations. However, particularly, medicine, e.g., insect repellent, that the user wishes to avoid direct contact may preferably be used.

The fluid container 1 includes the support body 100 and the nozzle body 200. The support body 100 and the nozzle body 200 are configured to be detachably engaged. The support body 100 includes a reservoir 101, a lid unit 102, a first engaging unit 104, a locking unit 106, a guide unit 107, a movement restriction unit 108, and an auxiliary pipe 109. The nozzle body 200 includes an opening formation unit 201, a pipe 202, a discharge port 203, a second engaging unit 204, and a protrusion portion 205.

The reservoir 101 has a space for accommodating the fluid F. The reservoir 101 has a tubular shape, and includes a base 1011 and an end portion 1012. The base 1011 includes a space for accommodating the fluid and does not engage with the nozzle body 200. The end portion 1012 has a space for accommodating the fluid of the base 1011 and engages with the nozzle body 200. The end portion 1012 has a cylindrical shape and includes therein a space for accommodating the fluid. The accommodation space of the base 1011 and the accommodation space of the end portion 1012 are integrated.

The material of the reservoir 101 of the support body 100 is preferably transparent or translucent so that the fluid inside can be viewed. Furthermore, at least the material of the base 1011 of the reservoir 101 is preferably so flexible that the base 1011 can be deformed when the user delivers the fluid. The fluid container 1 according to the present embodiment is configured to be not re-sealable after it is opened. Therefore, the reservoir 101 preferably has such a volume that the amount is used up in a single use.

The lid unit 102 of the support body 100 closes the internal space of the reservoir 101 before use. In use, the nozzle body 200 is moved in a first direction D1 in which the nozzle body 200 approaches the support body 100. Thus, an opening 103 is formed through the lid unit 102. The fluid F is guided to the nozzle body 200 from the interior of the reservoir 101 through the opening 103. It is sufficient that the material of the lid unit 102 is so rigid that that the opening 103 can be formed.

The first engaging unit 104 of the support body 100 is caught on the second engaging unit 204 of the nozzle body. The first engaging unit 104 is radially outwardly protruded from the outer circumferential surface of the end portion 1012 of the reservoir 101. The first engaging unit 104 extends along the circumferential direction of the end portion. The first engaging unit 104 is formed on each half circumference of the end portion 1012 in a predetermined pattern. The first engaging unit 104 is split into two in the circumferential direction of the end portion.

The first engaging unit 104 includes an engagement surface 105 that contacts the second engaging unit 204. The engagement surface 105 is an end surface of the first engaging unit 104 facing the base 1011 (downstream in the first direction). The engagement surface 105 includes a first region 1051 inclined in the first direction, a second region 1052 positioned at a downstream end in the first direction, and a third region positioned upstream in the first direction beyond the second region. The first region 1051 and the second region 1052 are contiguous in the circumferential direction of the end portion 1012. The second region 1052 and the third region 1053 are separated. The first region 1051 and the second region 1052 may be separated or may be contiguous in the circumferential direction of the end portion 1012.

The first region 1051 is inclined downstream in the first direction as it approaches the second region 1052. The length of the first engaging unit 104 in the first direction varies in the first region and gradually increases toward the second region 1052. When the second engaging unit 204 of the nozzle body 200 is moved while being engaged in the first region, the nozzle body 200 gradually approaches and the support body 100.

The position of the second region 1052 of the engagement surface is the closest to the base. In the second region, when the second engaging unit 204 of the nozzle body 200 is in a state of being engaged in the second region, the nozzle body 200 comes closest to the support body 100. It is configured such that the opening 103 is formed through the lid unit 102 by the opening formation unit 201 of the nozzle body 200 with the second engaging unit 204 of the nozzle body 200 being engaged in the second region.

The third region 1053 is farther from the base 1011 than the second region 1052. In use (when the fluid is discharged), the third region 1053 maintains the engagement state between the first engaging unit 104 and the second engaging unit 204 so that the nozzle body is in a state away from the support body 100 as compared to the time when the opening is formed. When the second engaging unit 204 of the nozzle body 200 is in a state of being in contact with the third region 1053, the nozzle body 200 is separated from the support body 100 as compared to the state where the nozzle body 200 is the closest to the support body 100. Furthermore, it is configured such that a part of the opening formation unit 201 of the nozzle body 200 is arranged outside of the reservoir 101 with the second engaging unit 204 of the nozzle body 200 being engaged in the third region 1053.

The locking unit 106 of the support body 100 is radially outwardly protruded from the outer circumferential surface of the end portion 1012 of the reservoir 101. The locking unit 106 is arranged opposite to the engagement surface 105 of the first engaging unit 104. A distance between the locking unit 106 and the engagement surface 105 is at least equal to or more than the length of the second engaging unit 204 in the first direction. The second engaging unit being in contact with the second region is held between the locking unit 106 and the engagement surface 105. The locking unit temporarily fixes the second engaging unit 204 in a second state where the second engaging unit 204 is engaged in the second region 1052.

The guide unit 107 of the support body 100 is radially outwardly protruded from the outer circumferential surface of the end portion 1012 of the reservoir 101. The guide unit 107 is arranged opposite to the engagement surface 105 of the first engaging unit 104. A distance between the guide unit 107 and the engagement surface 105 is at least equal to or more than the length of the second engaging unit 204 in the first direction. The second engaging unit being in contact with the first region is moved between the guide unit 107 and the engagement surface 105.

The movement restriction unit 108 of the support body 100 is radially outwardly protruded from the outer circumferential surface of the end portion 1012 of the reservoir 101. The movement restriction unit 108 is contiguous with the third region 1053 of the engagement surface 105. The movement restriction unit 108 is extended in the first direction and restricts the second engaging unit 204 being in contact with the third region 1053 from being further moved in the circumferential direction.

The auxiliary pipe 109 of the support body 100 is protruded upstream in the first direction from the surface of the lid unit 102. The auxiliary pipe 109 has a cylindrical shape. The auxiliary pipe 109 covers part of the outer circumferential surface of the opening formation unit 201 of the nozzle body 200. The auxiliary pipe 109 covers the space where the opening formation unit 201 is separated from the lid unit 102 when the opening formation unit is moved upstream in the first direction. The auxiliary pipe 109 and the opening formation unit 201 form a flow passage through which the fluid passes.

The fluid container 1 according to the present embodiment includes the locking unit 106, the guide unit 107, the movement restriction unit 108, and the auxiliary pipe 109. The fluid container according to the present invention may not include the locking unit 106, the guide unit 107, the movement restriction unit 108, and the auxiliary pipe 109.

The opening formation unit 201 of the nozzle body 200 is protruded toward the lid unit 102 from the inner surface of the nozzle body 200. The opening formation unit 201 forms the opening 103 through the lid unit 102. The opening formation unit 201 is arranged inside the inner circumferential surface of the auxiliary pipe 109 and is moved in a sliding manner with respect to the auxiliary pipe 109. The opening formation unit 201 has a cylindrical shape that extends in the first direction. In use (when the fluid is discharged), a hollow portion of the opening formation unit 201 is brought into communication with the reservoir 101 through the opening 103. The fluid in the reservoir 101 passes through the hollow portion of the opening formation unit 201 and is guided to the pipe 202 and the discharge port 203 to be described below.

The downstream end (end facing the lid) of the opening formation unit in the first direction is a piercing surface 2011 for tearing the lid unit. The lid unit 102 is torn by the piercing surface 2011 and the opening 103 is formed. The piercing surface 2011 varies in position in the first direction D1. Specifically, the distance between a downstream end 2012 of the piercing surface 2011 in the first direction and the lid unit 102 differs from the distance between an upstream end 2013 of the piercing surface in the first direction and the lid unit.

In the second state, the entire piercing surface 2011 is arranged within the reservoir 101. In the third state, a part of the piercing surface 2011 is arranged within the reservoir 101 and the other part of the piercing surface 2011 is arranged outside of the reservoir 101. More specifically, in the second state, both the downstream end 2012 of the piercing surface 2011 in the first direction and the upstream end 2013 of the piercing surface in the first direction are arranged within the reservoir 101. In the third state, the downstream end 2012 of the piercing surface in the first direction is arranged within the reservoir 101 and the upstream end 2013 of the piercing surface in the first direction is arranged outside of the reservoir 101.

The pipe 202 is a cylinder protruding upstream in the first direction D1. The pipe 202 of the nozzle body 200 is communicated with the opening 103 of the lid unit 102 through the opening formation unit 201. The pipe 202 has a cylindrical shape that extends in the first direction. In use (when the fluid is discharged), the hollow portion of the pipe 202 is brought into communication with the reservoir 101 through the opening formation unit 201 and the opening 103. The fluid in the reservoir 101 passes through the hollow portion of the pipe 202 and is sent to the discharge port 203. The upstream end of the pipe 202 in the first direction D1 constitutes the discharge port 203.

The second engaging unit 204 is formed on the inner circumferential surface of the nozzle body 200. The second engaging unit 204 engages with the first engaging unit 104. The second engaging unit 204 is radially inwardly protruded from an inner circumferential surface 2001 of the nozzle body 200. The second engaging unit 204 is formed at two points. The second engaging units 204 are arranged opposite to one another.

The protrusion portion 205 is protruded from the inner circumferential surface of the nozzle body 200. The protrusion portion 205 is configured to be capable of contacting the outer circumferential edge of the lid unit 102. The protrusion portion 205 is formed across the entire region of the inner circumferential surface of the nozzle body.

(2) Variant of the Use of the Fluid Container

Figure 7:
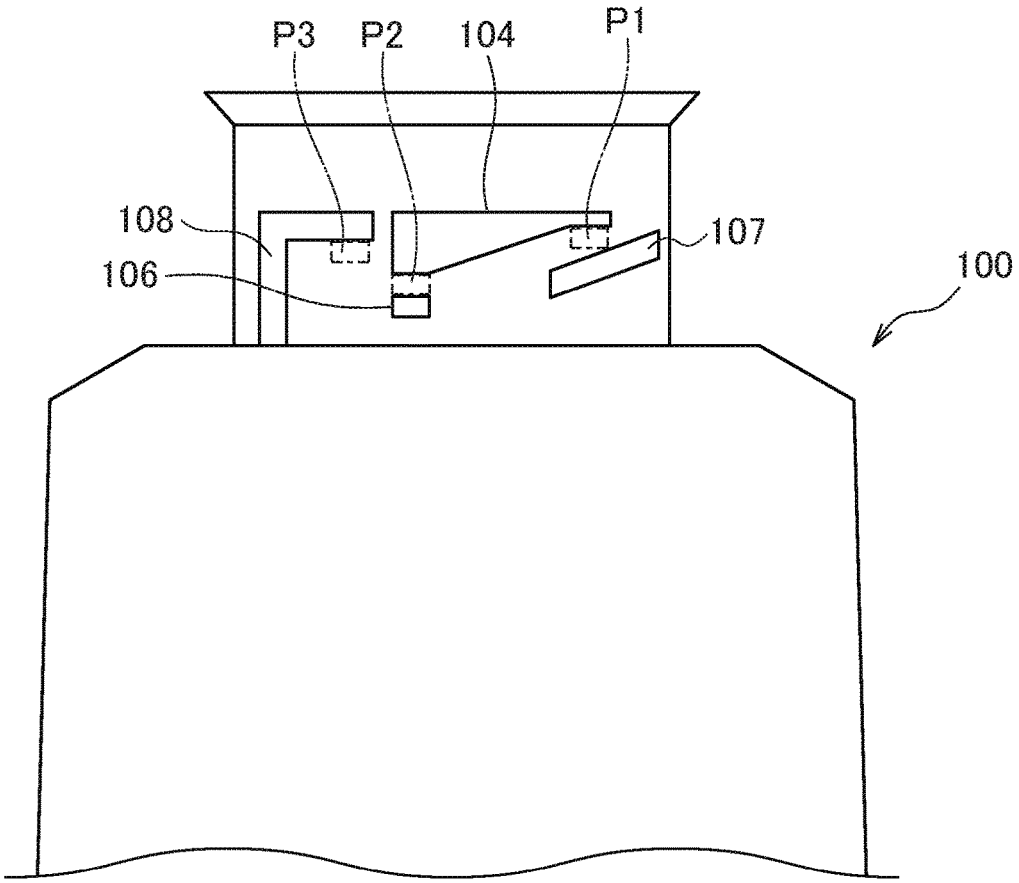
FIG. 7 is an explanatory view of an engagement state between a first engaging unit of a support body and a second catch of a nozzle body.

Next, a variant of the use of the fluid container configured in the aforementioned manner is described in detail in conjunction with FIGS. 4 to 7. FIGS. 4 to 7 are cross-sectional views of the fluid container along the first direction. FIG. 4 illustrates the first state. FIG. 5 illustrates the second state. FIG. 6 illustrates the third state. FIG. 7 is a view schematically illustrating the position of the second engaging unit in the front view of the support body of FIG. 2. FIG. 7 is an explanatory view of an engagement state between the first engaging unit 104 of the support body 100 and the second engaging unit 204 of the nozzle body 200. In FIG. 7, the position of the second engaging unit 204 in the first state is indicated at P1, the position of the second engaging unit 204 in the second state is indicated at P2, and the position of a third engaging unit in the third state is indicated at P3.

The fluid container 1 before use realizes the first state. Specifically, the second engaging unit 204 of the nozzle body 200 is positioned between the first engaging unit 104 and the guide unit 107 of the support body. More specifically, the second engaging unit 204 is positioned between the first region of the engagement surface 105 of the first engaging unit 104 and the guide unit 107. In the first state, the opening formation unit 201 of the nozzle body 200 and the lid unit 102 of the support body 100 are separated in an opposite state. The protrusion portion 205 of the nozzle body 200 and the lid unit 102 of the support body 100 are separated.

When the user rotates the nozzle body in rotation direction C (see FIGS. 1 and 2) in the first state, the second state is obtained. In a transition process from the first state to the second state, the second engaging unit 204 of the nozzle body 200 gradually moves downstream in the first direction along the engagement surface 105, and the nozzle body 200 gradually approaches and the support body 100. In the transition process from the first state to the second state, the protrusion portion 205 of the nozzle body 200 contacts the lid unit 102 of the support body 100. Therefore, in further moving the nozzle body in the rotation direction with the protrusion portion 205 being in contact with the lid unit 102, the user moves the nozzle body in the rotation direction while pressing the nozzle body 200 toward the support body 100. Thus, in the second state, the protrusion portion 205 and the lid unit 102 contact and are pressed against one another.

Furthermore, in the transition process from the first state to the second state, the opening formation unit 201 of the nozzle body 200 tears a part of the lid unit 102 of the support body 100, and the opening formation unit 201 penetrates the lid unit 102. Thus, the opening 103 is formed through the lid unit 102. In the second state, the entire piercing surface 2011 of the opening formation unit penetrates the lid unit 102 and is arranged within the reservoir 101. In the second state, the second engaging unit 204 of the nozzle body is positioned between the second region 1052 of the engagement surface 105 of the first engaging unit 104 and the locking unit 106.

When the user rotates the nozzle body in the rotation direction C in the second state, the third state is obtained. When the user rotates the nozzle body in the rotation direction C in the second state, the engagement between the first engaging unit 104 and the second engaging unit 204 in the second state is released. The protrusion portion 205 and the lid unit 102 press against one another in the second state. Therefore, when the engagement between the first engaging unit 104 and the second engaging unit 204 is released, the protrusion portion 205 and the lid unit 102 are moved away from one another so as to return to the initial state. Therefore, the nozzle body 200 is moved in a direction away from the support body 100 (second direction D2 opposite to the first direction D1), and the third state is obtained. In the third state, the protrusion portion 205 and the lid unit 102 are separated, or in contact with one another but do not press against one another.

In the third state, a part of the piercing surface 2011 of the opening formation unit is arranged within the reservoir 101. Specifically, the downstream end 2012 of the piercing surface in the first direction is arranged within the reservoir 101, and the upstream end 2013 of the piercing surface in the first direction is arranged outside of the reservoir 101. Furthermore, in the third state, the second engaging unit 204 of the nozzle body 200 is positioned upstream in the first direction as compared to that in the second state.

When the user rotates the nozzle body in the rotation direction C from the third state and the second engaging unit 204 takes a position beyond the third region, the second engaging unit 204 contacts the movement restriction unit 108. Therefore, the second engaging unit 204 does not move in the rotation direction beyond the third region.

The user may understand that the nozzle body 200 has been rotated into a usable state because the nozzle body 200 cannot be rotated any further with respect to the support body. The user may discharge the fluid with respect to a target with the fluid container 1 in the third state. Specifically, the discharge port 203 is placed on a target, and the base 1011 of the support body 100 is pressed. The fluid F is guided to the nozzle body 200 from the reservoir 101 of the support body 100 through the opening 103. The fluid F guided to the nozzle body 200 passes through the opening formation unit 201 and the pipe 202, and is delivered through the discharge port 203.

(3) Operation and Effect

The fluid container 1 is configured to realize the second state where the opening 103 is formed on the support body 100 and the third state where the support body 100 and the nozzle body 200 are separated as compared to those in the second state. The user delivers the fluid F in the third state. In a state where the fluid F is delivered, the opening formation unit 201 of the nozzle body 200 takes a position that is shallower than the deepest position (position in the second state). Therefore, the volume of the opening formation unit 201 arranged within the reservoir 101 is reduced, which enables prevention of the opening formation unit 201 from interfering with the movement of the fluid toward the nozzle body 200 from the interior of the reservoir 101. As a result, the fluid F is prevented from being left in the fluid container 1. In the case of the fluid container 1 accommodating medicine, e.g., insect repellent, a specified amount can be used in a single use without excess or deficiency, facilitating the provision of a desired effect.

In the second state, the surface of the second engaging unit 204 on the upstream side in the first direction contacts the surface (engagement surface 105) of the first engaging unit 104 on the downstream side in the first direction and is pressed downstream in the first direction. Furthermore, the surface of the protrusion portion 205 on the downstream side in the first direction contacts the lid unit 102 of the support body 100 and is pressed upstream in the first direction by the lid unit 102. A part (second engaging unit) of the nozzle body 200 is pressed downstream in the first direction, and the other part (protrusion portion 205) of the nozzle body 200 is pressed upstream in the first direction. Therefore, in the second state, the nozzle body 200 is closely attached to the support body 100, enabling prevention of misalignment between the nozzle body 200 and the support body 100.

The first region 1051, the second region 1052 and the third region 1053 of the engagement surface 105 of the first engaging unit 104 differ in position in the first direction D1. Therefore, when the second engaging unit 204 is moved along the engagement surface 105 of the first engaging unit 104, the nozzle body 200 is made close to or away from the support body 100, thereby enabling a change of the positional relationship between the nozzle body 200 and the support body 100.

In a state where the second engaging unit 204 of the nozzle body 200 is engaged in the second region, a part of the outer surface of the support body 100 and a part of the inner surface of the nozzle body 200 are in contact are pressed against one another. It is configured such that the nozzle body 200 approaches the support body 100 while the user applies a force to press the nozzle body against the support body and the first engaging unit is caught on the second engaging unit. In a state where the second engaging unit is in contact with the second region, the nozzle body 200 and the support body 100 press against one another to a maximum extent, and a force is applied in a direction in which the nozzle body 200 and the support body 100 are moved away from one another to a maximum extent. Therefore, in a state where the second engaging unit is in contact with the second region, the positions with respect to one another are misaligned in some cases. However, as the locking unit 106 is arranged, the second engaging unit can be held between the locking unit 106 and the engagement surface 105.

In the second state, the entire piercing surface 2011 is arranged within the reservoir 101. In the third state, a part of the piercing surface 2011 is arranged within the reservoir 101 and the other part of the piercing surface 2011 is arranged outside of the reservoir 101. When the opening 103 is formed, the piercing surface 2011 fully penetrates the lid unit 102 and the opening 103 is generally formed reliably. In use (when the fluid is discharged), a part of the piercing surface 2011 is arranged outside of the reservoir 101 and the fluid that flows through the opening 103 is not blocked. Thus, when the opening 103 is formed, the opening 103 can be formed reliably, facilitating full use of the fluid present within the reservoir 101.

The support body 100 and the nozzle body 200 are formed of a transparent or translucent material. The user can view the amount or position of fluid in the support body 100 and the nozzle body 200. Therefore, when the fluid is delivered, the remaining amount can be viewed and whether the fluid has been used up can be checked. Thus, the accommodated fluid is hardly left in the reservoir 101.

(4) Other Variation

Figure 8:
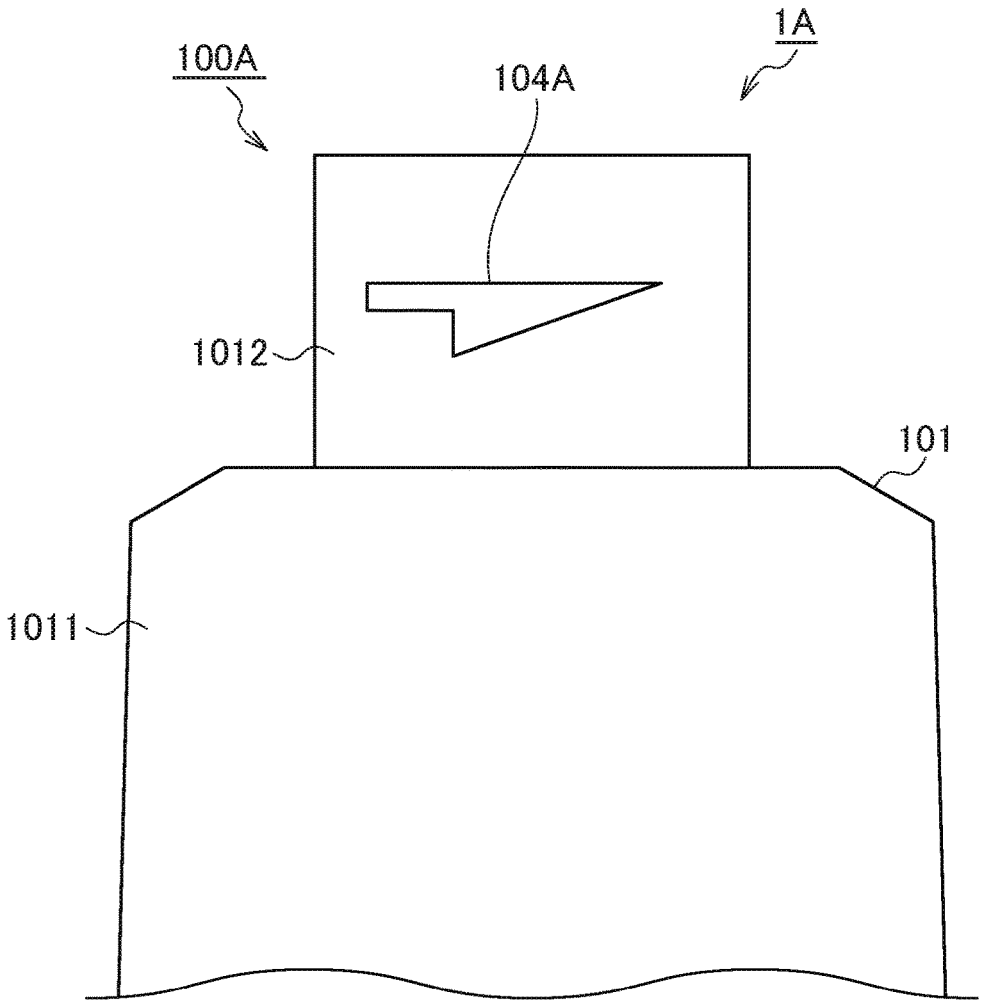
FIG. 8 is a partially enlarged front view of a support body according to a variation.
Figure 9:
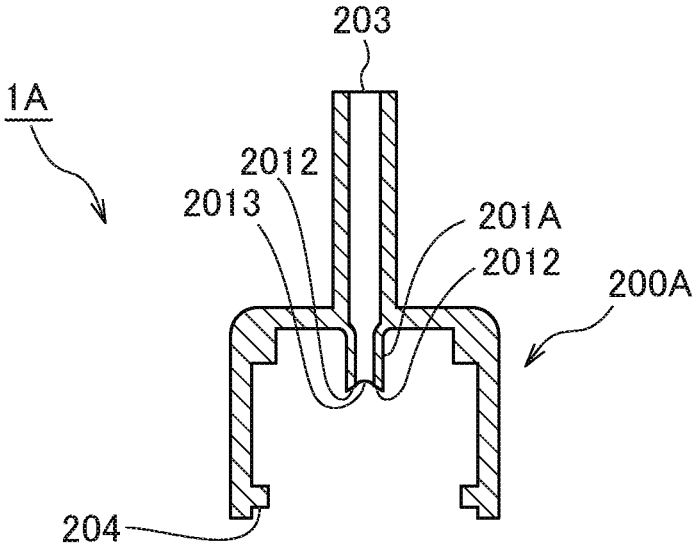
FIG. 9 is a cross-sectional view of a nozzle body along the first direction according to a variation.

Next, another variation is described. In the description of the variation, the same configurations as those of the embodiment are designated by the same reference numerals and the description is omitted. A fluid container 1A according to the variation differs in configuration of the support body from that of the embodiment. FIG. 8 is a partially enlarged front view of a support body 100A of the fluid container 1A according to the variation. FIG. 9 is a view illustrating a nozzle body 200A of the fluid container 1A according to the variation.

The fluid container 1A according to the variation is not formed of two-split first engaging units 104, but include one first engaging unit 104A having a first region 1051, a second region 1052 and a third region 1053. Since the first engaging unit 104A is integrated, a projection can be smoothly moved along the circumferential direction of the end portion 1012.

Furthermore, the support body 100A of the fluid container 1A according to the variation does not include the locking unit 106, the guide unit 107 and the movement restriction unit 108.

FIG. 9 is a view illustrating the nozzle body 200A of the fluid container 1A according to the variation 1A. FIGS. 9(*a*) and (*b*) are cross-sectional views along the first direction of the nozzle body 200A. FIG. 9(*a*) is a cross-section viewed from a predetermined position. FIG. 9(*b*) is a cross-sectional view viewed at an angle that is 90 degrees different from that of FIG. 9(*a*).

An opening formation unit 201A according to the variation 1A differs from the opening formation unit of the embodiment. The opening formation unit 201A according to the variation includes multiple downstream ends 2012. The multiple downstream ends 2012 are arranged 180 degrees apart in the circumferential direction. Therefore, when the opening 103 is formed, the downstream ends 2012 at two points tear the lid unit 102 and form the opening 103 having a circular shape. Furthermore, in the third state, multiple points (the downstream ends 2012 at two points) of the piercing surface of the opening formation unit are arranged within the reservoir.

For example, when the downstream end 2012 at one point tears the lid unit 102 and forms the opening 103, in some cases, a part of the lid unit 102 is not torn and the lid unit 102 is partially adhered to the lid unit 102 as a valve. In a state where a valve is adhered to the lid unit 102 as described above, there is a possibility that the valve interferes with the movement of the fluid and the fluid is left in the reservoir 101. However, when the multiple downstream ends 2012 tear the lid unit 102 as described above, the lid unit 102 is prevented from being partially left in the vicinity of the opening 103. Smooth movement of the fluid is ensured, and the fluid is hardly left in reservoir 101.

Heretofore, the present invention has been described in detail in conjunction with the aforementioned embodiment. However, it is obvious to those skilled in the art that the present invention is not limited to the embodiment described in the present specification. The present invention may be carried out as a modification and an alternation without departing from the gist and scope of the present invention specified by the statements of the claims. Therefore, the description of the present specification is intended for illustrative and descriptive purposes, but does not have any limitations on the present invention.

The entire content of JP Patent Application No. 2014-186916 filed on Sep. 12, 2014 is incorporated by reference herein.

INDUSTRIAL APPLICABILITY

According to the present invention, a fluid container in which an accommodated fluid is hardly left in a reservoir can be provided.

REFERENCE SIGNS LIST

1, 1A fluid container
100, 100A support body
101 reservoir
1011 base
1012 end portion
102 lid unit
103 opening
104, 104A first engaging unit
105 engagement surface
1051 first region
1052 second region
1053 third region
106 locking unit
107 guide unit
108 movement restriction unit
109 auxiliary pipe
200, 200A nozzle body
201, 201A opening formation unit
2011 piercing surface
2012 downstream end
2013 upstream end
202 pipe
203 discharge port
204 second engaging unit
205 protrusion portion
C rotation direction
F fluid
D1 first direction
D2 second direction

The invention claimed is:

1. A fluid container, comprising:

a support body having a reservoir for accommodating fluid;

a lid unit for closing the reservoir; and a pair of first engaging units each provided with an engagement surface; and a nozzle body attachable to the support body and including an opening formation unit for forming an opening through at least a part of the lid unit;

a pipe provided in the opening formation unit and configured to permit passage of the fluid;

a discharge port communicating with the pipe and configured to discharge the fluid;

a pair of second engaging units located on an inner circumferential surface of the nozzle body, the second engaging units being configured to engage with the engagement surfaces of the first engaging units, respectively; and a protrusion portion protruding from the inner circumferential surface of the nozzle body and located upstream of the second engaging units in a first direction in which the nozzle body moves toward the support body to be attached to the support body, wherein the nozzle body is rotatable in a rotation direction of the nozzle body from a first state, to a second state, and then to a third state with respect to the support body, in the first state, the opening formation unit and the lid unit are separated from each other, and the opening formation unit is located at a first position relative to the lid unit, in the second state, the opening formation unit passes through the lid unit and located at a second position relative to the lid unit, and the protrusion portion contacts and presses against the support body in the first direction, and in a third state, the opening formation unit is located at a third position downstream of the first position in the first direction and upstream of the second position in the first direction, the engagement surface of each of the first engaging units is an end surface of the first engaging unit and configured to face the corresponding second engaging unit in the first direction, the support body further includes a movement restriction unit radially outwardly protruding from an outer circumferential surface of the support body and configured to restrict a further rotation of the nozzle body in the rotation direction from the third state, the first engaging units are separately formed on different halves of the outer circumferential surface of the support body, and the second engaging units are separately formed on different halves of the inner circumferential surface of the nozzle body.

2. The fluid container according to claim 1, wherein the engagement surface of each of the first engaging units includes a first region inclined downstream in the first direction, a second region positioned downstream of the first region in the first direction, and a third region positioned upstream of the second region in the first direction, in the first state, each of the second engaging units is engaged with the first region of the engagement surface of the corresponding first engaging unit, in the second state, each of the second engaging units is engaged with the second region of the engagement surface of the corresponding first engaging unit, and in the third state, each of the second engaging units is engaged with the third region of the engagement surface of the corresponding first engaging unit.

3. The fluid container according to claim 2, wherein the support body further includes a locking unit protruding outwardly from the outer circumferential surface of the support body and located downstream of the first engaging units in the first direction, and the locking unit is configured to temporarily fix one of the second engaging units in the second region in the second state where said one of the second engaging units is engaged with the engagement surface of the corresponding first engaging unit.

4. The fluid container according to claim 2, wherein a length of each of the first engaging units gradually increases from the first region toward the second region in the first direction, and the nozzle body is configured to move in the first direction gradually toward the support body when one of the second engaging units is moved while being engaged with the first region of the engagement surface of the corresponding first engaging unit.

5. The fluid container according to claim 1, wherein the opening formation unit has a piercing edge facing the lid unit in the first direction and configured to tear the lid unit to form the opening, the piercing edge is inclining in the first direction, in the second state, an entirety of the piercing edge is arranged within the reservoir, and in the third state, a part of the piercing edge is arranged within the reservoir and a different part of the piercing edge is arranged outside the reservoir.

6. The fluid container according to claim 5, wherein the piercing surface of the opening formation unit has an upstream end, and multiple downstream ends downstream of the upstream end in the first direction, and in the third state, the multiple downstream ends of the piercing edge of the opening formation unit are arranged within the reservoir whereas the upstream end of the piercing edge of the opening formation unit is arranged outside the reservoir.

7. The fluid container according to claim 1, wherein the support body and the nozzle body are formed of a transparent or translucent material.

8. The fluid container according to claim 1, wherein the nozzle body is configured to rotate in the rotation direction while moving toward the support body in the first direction from the first state to the second state, and the nozzle body is configured to rotate in the rotation direction while moving away from the support body in a second direction from the second state to the third state, the second direction being opposite to the first direction.

9. The fluid container according to claim 1, wherein the support body further includes a guide unit radially outwardly protruding from the outer circumferential surface of the support body, wherein the guide unit is arranged opposite to the engagement surfaces of the first engaging units and configured to guide one of the second engaging units to move while said one of the second engaging units is engaged with the engagement surface of the corresponding first engaging unit.

10. The fluid container according to claim 9, wherein the guide unit is opposite to one of the engagement surfaces in a same half of the outer circumferential surface of the support body, a distance between the guide unit and said one of the engagement surfaces in the first direction is equal to or more than a length of the second engaging unit in the first direction.

11. A fluid container, comprising:

a support body having a reservoir for accommodating fluid; and a nozzle body attached to the support body, wherein the support body has a lid unit for closing the reservoir, the nozzle body includes:

an opening formation unit for forming an opening through at least a part of the lid unit;

a pipe communicating with the opening of the lid unit, the pipe permitting passage of the fluid; and a discharge port communicating with the pipe, the discharge port discharging the fluid, the fluid container is configured to realize a first state where the opening formation unit and the lid unit are separated as the nozzle body and the support body are engaged, a second state where the opening of the lid unit is formed by the opening formation unit as the nozzle body moves in a first direction to approach the support body from the first state, and a third state where at least a part of the opening formation unit and the lid unit are separated as the nozzle body moves in a second direction opposite to the first direction from the second state, the nozzle body includes a second engaging unit, the support body includes a first engaging unit provided with an engagement surface that engages with the second engaging unit, the engagement surface of the first engaging unit is an end surface of the first engaging unit and configured to face the second engaging unit in the first direction, an inner circumferential surface of the nozzle body is arranged opposite to the support body, the inner circumferential surface of the nozzle body includes the second engaging unit, and a protrusion portion that is positioned upstream of the second engaging unit in the first direction and that is protruded from the inner circumferential surface, in the second state, a surface of the protrusion portion contacts and presses against the support body in the first direction, the engagement surface of the first engaging unit includes a first region inclined toward the first direction, a second region positioned downstream of the first region in the first direction, and a third region positioned upstream of the second region in the first direction, the first state is realized with the second engaging unit being engaged in the first region, the second state is realized with the second engaging unit being engaged in the second region, the third state is realized with the second engaging unit being engaged in the third region, the support body further includes a locking unit protruding outwardly from the outer circumferential surface of the support body and located downstream of the first engaging unit in the first direction, and the locking unit is configured to temporarily fix the second engaging unit in the second region in the second state where the second engaging unit is engaged with the engagement surface of the first engaging unit.

* * * * *